United States Patent [19]

Curran

[11] 3,966,105

[45] June 29, 1976

[54] WEB ALIGNING APPARATUS

[75] Inventor: Thomas F. Curran, Hoffman Estates, Ill.

[73] Assignee: Cary Metal Products, Inc., Barrington, Ill.

[22] Filed: Aug. 10, 1973

[21] Appl. No.: 387,235

[52] U.S. Cl. ..... 226/21

[51] Int. Cl.[2] ..... B65H 25/26

[58] Field of Search ..... 226/18, 21, 22, 23, 226/15

[56] References Cited

UNITED STATES PATENTS

| | | | |
|---|---|---|---|
| 3,583,615 | 6/1971 | Ott | 226/20 |
| 3,724,732 | 4/1973 | Bonner | 226/21 |

FOREIGN PATENTS OR APPLICATIONS

| | | | |
|---|---|---|---|
| 209,292 | 5/1960 | Austria | 226/21 |

*Primary Examiner*—Richard A. Schacher
*Attorney, Agent, or Firm*—Hibben, Noyes & Bicknell

[57] ABSTRACT

A web aligning apparatus is disclosed wherein a web path correcting tilt frame is mounted for tilting movement between the laterally spaced side plates of the tilt frame support structure. The tilt frame includes a pair of laterally spaced frame members which extend generally longitudinally of the path of travel of the web through the apparatus and which rotatably support a pair of steering rollers therebetween. The axes of the steering rollers extend generally transversely to the path of travel of the web through the apparatus. A pair of elongated links respectively connect the tilt frame members with the support structure side plates and are arranged so that the instantaneous center of rotation of the tilt frame is located outside the perimeter of the tilt frame and shifts along an arcuate path that extends laterally of the path of travel of the web with tilting movements of the tilt frame.

26 Claims, 9 Drawing Figures

Fig. 3.
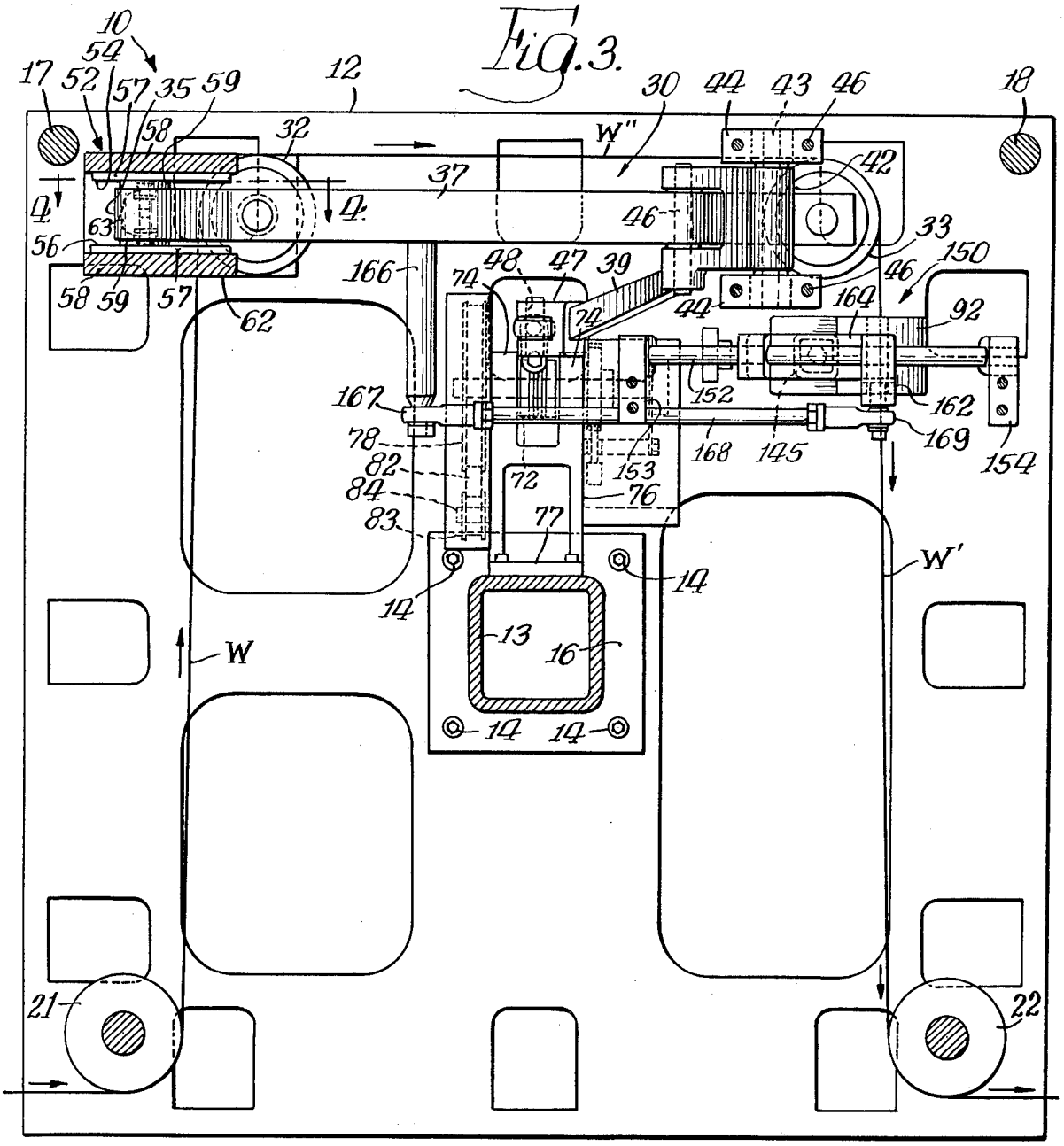
Fig. 4.
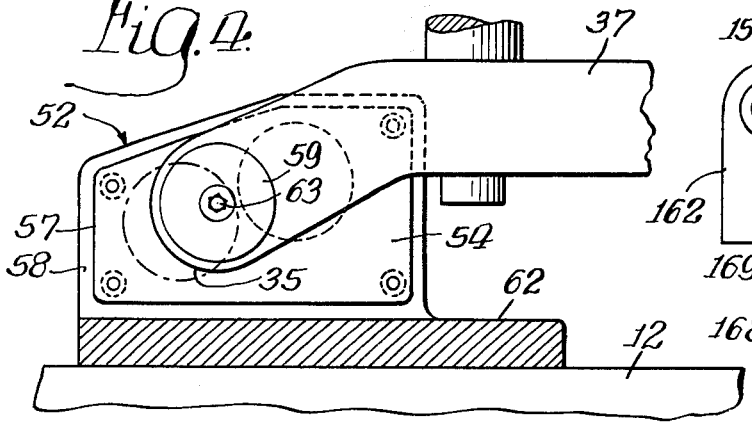
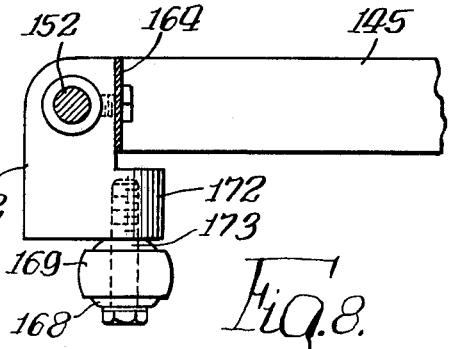
Fig. 8.

WEB ALIGNING APPARATUS

This invention relates to apparatus for sensing deviations of a moving web from a desired path of travel and for automatically returning the web to the desired path of travel.

Various types of web aligning or straightening devices have been heretofore advanced for maintaining a continuous web of material, such as newsprint or the like, on a desired path of travel as the latter approaches, passes through and emerges from an associated device, such as a printing press, slitter, or the like. Even relatively minute changes in the lateral position of the web as it passes through a printing press, for example, can result in printing errors which render the end product unusable.

Some examples of web aligning devices heretofore advanced for sensing deviations in the lateral position of a web from a desired path and for correcting such deviations are disclosed in the Ott, Jr., U.S. Pat. No. 3,682,362, Martin U.S. Pat. No. 3,615,048, Bartles, et al. U.S. Pat. No. 3,411,683, Otepka, et al. U.S. Pat. No. 3,373,288 and Japanese Patent No. 45 37216. Each of the web aligning devices disclosed in the aforementioned prior art patents utilizes a pair of steering rollers rotatably mounted in a frame or carriage so that the axes of the rollers are parallel and extend generally transversely to the path of travel of the web and so that the axis about which the frame pivots is tangent to the web at the point where the latter contacts the entrance roller or separates from the exit roller of the frame.

Some examples of some other web aligning devices in which the axis about which the steering roller frame pivots is fixed and located other than in the plane of the web at the point of tangency thereof to the entrance roller are shown in the Faeber U.S. Pat. No. 2,821,387 and German Patent No. 1,230,641. The Fife U.S. Pat. No. 2,797,091 discloses a web shifting apparatus wherein the mounting for the guide rollers thereof is such that the rollers undergo a combined lateral shifting and swiveling movement when the apparatus is performing a web aligning function.

Various types of drive arrangements have also been utilized in the web aligning devices heretofore advanced for effecting movement of the tilt frames or carriages thereof. Thus, a piston and cylinder type drive arrangement is disclosed in the Otepka, et al. U.S. Pat. No. 3,373,288. Moreover, the Neifeld, et al. U.S. Pat. No. 3,512,691 discloses a cable and drum arrangement in the mechanism thereof which tracks the path of the web moving through the apparatus.

While many of the web shifting or aligning devices heretofore advanced have proven generally satisfactory for their intended purpose, others have not for various reasons such as inability to precisely control the path of movement of the web, creation of excessive sheer stresses in the web during tracking corrections, structural complexity, and excessive cost.

Accordingly, it is a general object of the present invention to provide a novel and improved web aligning apparatus which overcomes the aforementioned disadvantages of the prior art.

Another object is to provide a novel web aligning apparatus having at least one steering roller for maintaining a moving web on a desired path of travel, wherein the roller is rotatably mounted in a movable tilt frame or carriage and wherein the instantaneous center about which the tilt frame pivots is at all times located upstream from the steering roller and shifts generally laterally of the path of travel of the web with movements of the tilt frame.

A further object is to provide a novel web aligning apparatus of the foregoing character, wherein the locus of movement of the instantaneous center of the tilt frame is along an arcuate path.

A more particular object is to provide a novel web aligning apparatus which utilizes sliding bearings for supporting and guiding the tilt frame of the apparatus.

Another object is to provide a novel web aligning apparatus of the character described, wherein a cable and capstan drive arrangement is utilized to effect movements of the tilt frame thereof.

Still another object is to provide a novel web aligning apparatus of the foregoing character, wherein a tension indicating device is utilized in at least one of the end connections of the cable of the cable and capstan drive arrangement thereof to facilitate adjustment of the tension in the cable.

A further object is to provide a novel web aligning apparatus of the character described, wherein a mounting structure is utilized to support the ends of the scanner head support bar of the apparatus which assures accurate tracking of the edge of the web by the scanner heads during movements of the tilt frame and which compensates for minor inaccuracies of the parts.

Still another object is to provide a novel web aligning apparatus of the character described, wherein the construction of the tie rod which connects the linkage for effecting tilting of the tilt frame is such as to accommodate small changes in the spacing between the parts of the tilt frame linkage to which the tie rod is connected during movements of the tilt frame and also to provide a biasing force on the tilt frame tending to maintain the latter in a neutral position.

Other objects and advantages of the invention will become apparent from the following detailed description and accompanying sheets of drawings, in which:

FIG. 1 is a perspective view of a web aligning apparatus embodying the features of the present invention;

FIG. 2. is a top plan view of the web aligning apparatus shown in FIG. 1;

FIG. 3. is a staggered sectional view taken along the lines 3—3 of FIG. 2;

FIG. 4 is an enlarged, fragmentary sectional view taken along the line 4—4 of FIG. 3;

FIG. 8 is a sectional view taken along the line 8—8 of FIG. 2; and

Figures 1, 5, 6, 7, 9:
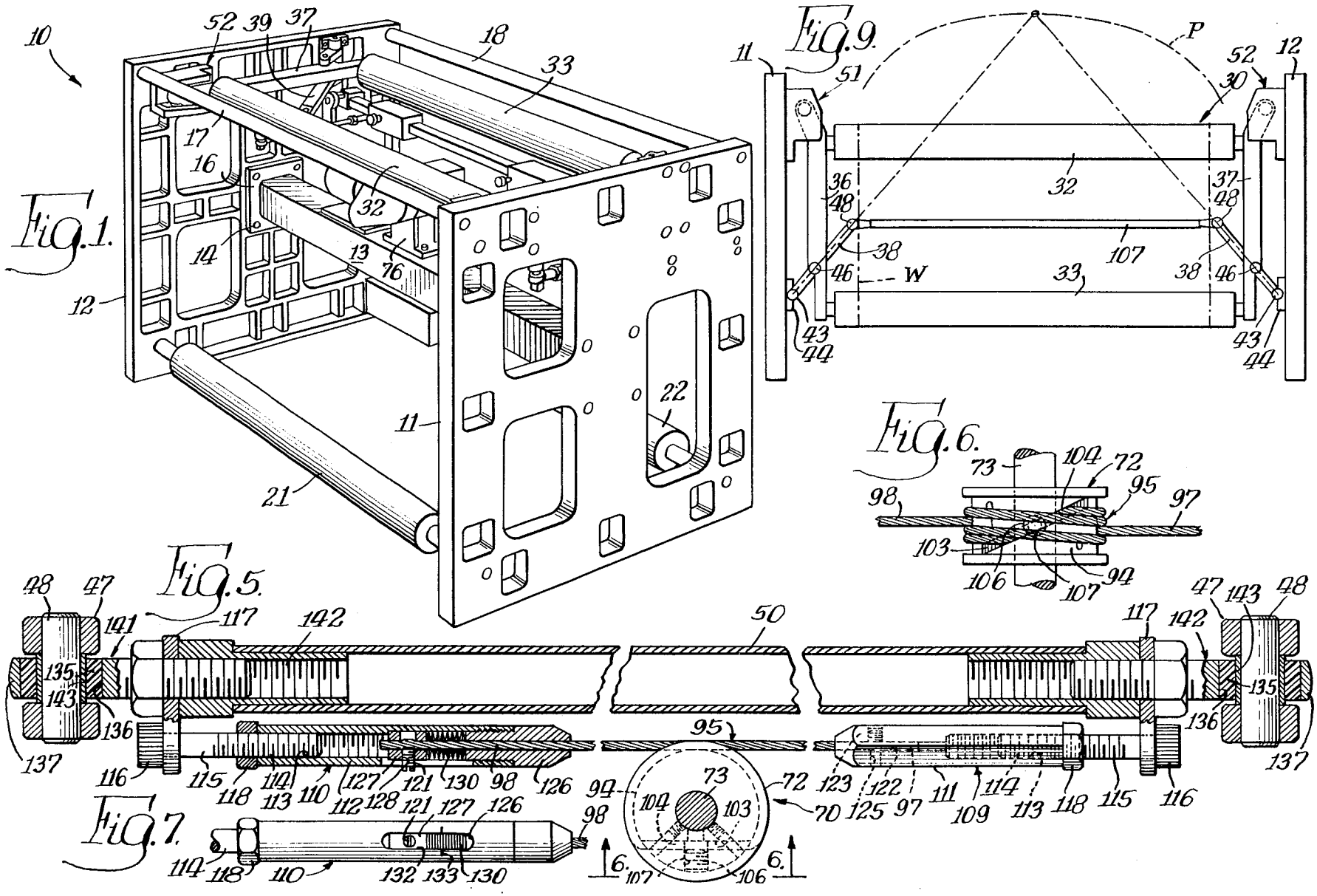
FIG. 5 is a somewhat enlarged, broken longitudinal sectional view taken along the line 5—5 of FIG. 2.
FIG. 6 is an elevational view showing additional details of the cable and capstan drive for the tilt frame of the apparatus.
FIG. 7 is a fragmentary elevational view of a cable tension indicating device utilized in the cable of the cable and capstan drive of the apparatus.
FIG. 9 is a diagrammatic view, on a reduced scale, of the tilt frame of the apparatus and showing the changes in position of the instantaneous center thereof with changes in the position of the tilt frame.

In FIG. 1, a web aligning apparatus embodying the features of the present invention is illustrated and indicated generally at 10. The apparatus 10 comprises support structure in a form of a pair of laterally spaced, parallel support members or plates 11 and 12 which are rigidly interconnected and maintained in laterally spaced relation by a cross member or beam 13. In the present instance, the beam 13 is centrally secured to the inner surfaces of the support plates 11 and 12 as by screws 14 which extend through a flange or end plate 16 at each end of the beam member 13 and which are threaded into the support plates. In the present instance, the beam 13 is tubular and rectangular in cross section (FIG. 3), and the end plates 16 are likewise rectangular (FIGS. 1 and 3). A pair of tie rods 17 and 18 extend between and are secured to the plates 11 and 12 adjacent the upper corners thereof, as viewed in FIGS. 1 and 3, and serve to further increase the rigidity of the support structure. A pair of idler rollers 21 and 22 extend transversely between and are rotatably journalled at their ends in the plates 11 and 12 adjacent the lower corner edges thereof. The idler rollers 21 and 22 serve to change the direction of a web as it enters and leaves the apparatus 110. Such web is indicated generally at W in the figures.

Figure 2:
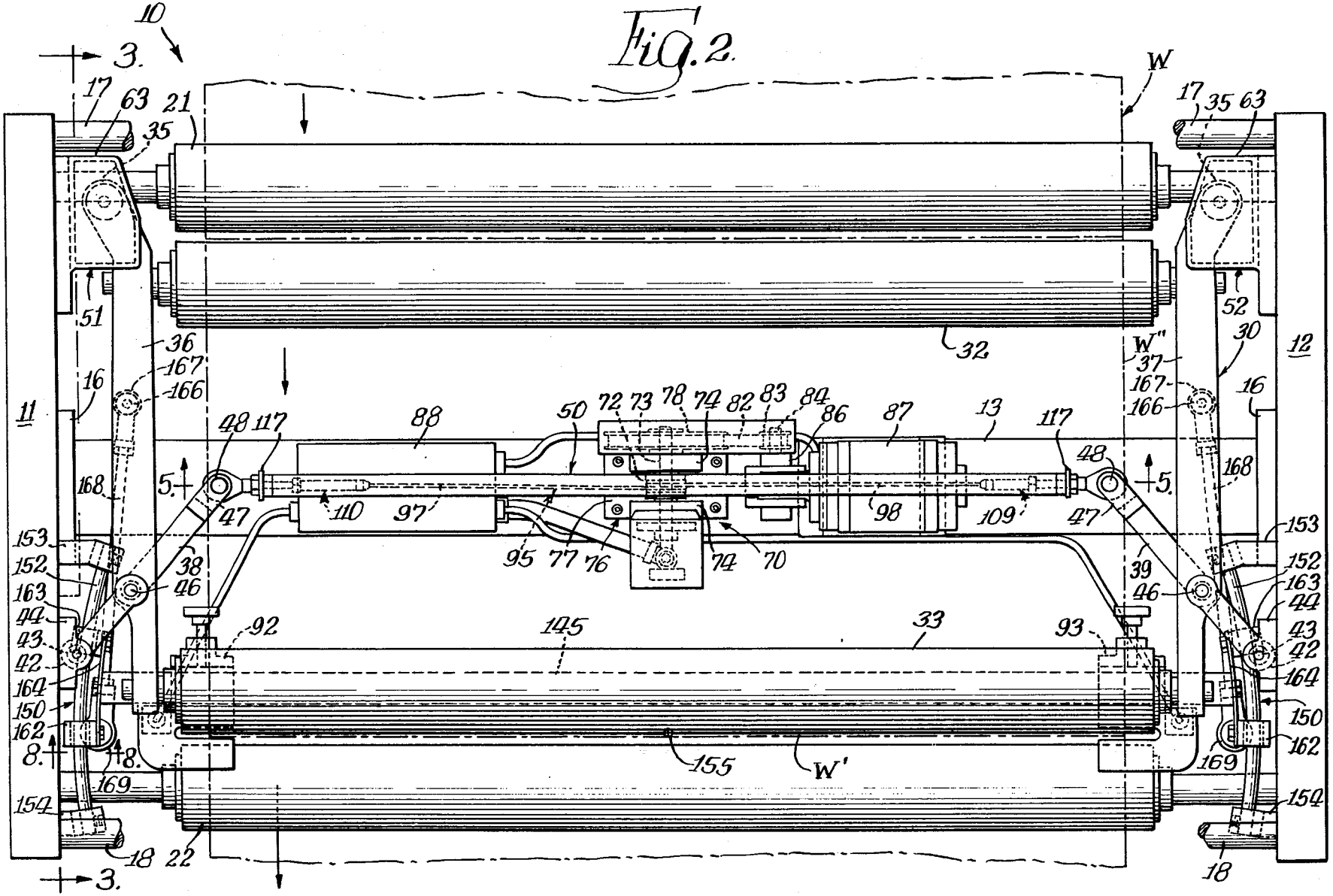

Referring now to FIGS. 2 and 3 in conjunction with FIG. 1, it will be seen that the web aligning apparatus 10 includes frame means in the form of a tilt frame or carriage 30 for correcting lateral deviations in the path of travel of the web W from a desired path as the web passes through the apparatus. The apparatus 10 will, of course, correct the path of travel of the web W for a distance upstream and downstream from the apparatus.

The tilt frame 30 preferably comprises at least one and preferably a pair of steering rollers 32 and 33 spaced longitudinally of the path of travel of the web W through the apparatus 10 and arranged with their axes parallel and extending generally transverse to said path. The rollers 32 and 33 are rotatably journalled at their ends in side frame members 36 and 37 and the frame members 36 and 37 also maintain the rollers 32 and 33 in fixed spatial relation with respect to each other.

According to the present invention, mounting means is provided for the tilt frame 30 which permits the frame 30 to rotate about an instantaneous center which is located upstream from or forwardly of the entrance roller 32 of the tilt frame 30 and which shifts generally laterally of the path of the web during web path correcting or tilting movements of the tilt frame 30. The aforementioned mounting means thus comprises link means in the form of a pair of generally J-shaped link members 38 and 39, each of which is pivotally connected at its bight or saddle portion 42 (FIGS. 1, 2 and 3) by pins 43 extending through transverse bores in the saddle portions 42 and rotatably journalled in bearing blocks 44. The bearing blocks 44 may be secured as by screws 46 to the inner surfaces of the plates 11 and 12 adjacent the upper horizontal edges of the plates and toward the rear or right side edges thereof as viewed in FIG. 3.

The frame members 36 and 37 are positioned between the bifurcated portions of the links 38 and 39 and pivotally secured thereto by cross pins 46 which extend through cross bores in the frame members 36 and 37. The length of the bifurcated portions of the links 38 and 39 between the pins 43 and 46 is such that the links are inclined forwardly and inwardly toward the forward or entrance roller 32 throughout the normal range of tilting movement of the tilt frame 30. Moreover, the inclination of the links 38 and 39 is such that the instantaneous center of rotation of the tilt frame 30 is at all times located outside the perimeter of the tilt frame and upstream therefrom, as aforesaid.

A portion of each of the links 38 and 39 extends inwardly beyond the pivot pins 46 and terminates in a bifurcated portion 47 (FIGS. 2 and 3) having aligned cross bores therethrough for receiving a pin 48. Each pin 48 serves to pivotally connect one of the respective ends of a tie rod 50 to the end portions 47 of the links 38 and 39. Thus, lateral shifting movement of the tie rod 50 in opposite, generally axial directions serves to effect pivotal movement of the links 38 and 39 about the pins 43 and consequently affects a corresponding pivotal movement of the tilt frame members 36 and 37 about the axes of the pins 46. The type of tilting movement imparted to the tilt frame 30 as a result of the aforementioned linkage connections will be described more fully hereinafter.

In order to provide support for the forward or upstream ends, indicated at 35, of the frame members 36 and 37 and to guide the ends 35 during tilting movements of the frame 30, novel sliding bearing means is provided. Such sliding bearing means comprises a pair of sliding bearing assemblies 51 and 52 respectively mounted on the inner surfaces of the support plates 11 and 12 adjacent the tie rod 17.

Referring now to FIG. 4 in conjunction with FIGS. 2 and 3, it will be seen that each of the sliding bearing assemblies 51 and 52 comprises a pair of transversely spaced, parallel, flat bearing surfaces 54 and 56 respectively provided by the adjacent inner surfaces of a pair of vertically spaced plates 57, which are preferably of tool steel and which are secured to the opposite inner surfaces of the parallel flange portions, indicated at 58, of a channel-shaped member or support 62. Since the frame members 36 and 37 are preferably of high strength steel, a pair of disk-shaped bearing members 59 of bronze or some other suitable bearing material are secured to the upper and lower side faces of the frame members 36 and 37, as viewed in FIG. 3, for sliding engagement with the bearing surface 54 of the bearing plates 57. The bearing members 59 may be secured to the frame members 36 and 37 as by recessed screws 63. The sliding bearing assemblies 51 and 52 thus support the forward ends 35 of the tilt frames 36 and 37 and accommodate free sliding movement thereof in a horizontal plane as viewed in FIG. 3.

In order to effect movements of the tie rod 50 in opposite directions and hence tilting movements of the frame 30, a novel cable and capstan drive means, indicated generally at 70, is provided. Referring now to FIGS. 5 and 6 in conjunction with FIGS. 2 and 3, it will be seen that the cable and capstan drive means 70 comprises a capstan or drum 72 secured to a shaft 73 which is rotatably mounted in the flanges 74 of a generally H-shaped support member 76, the latter being bolted or otherwise secured to the upper surface of the cross beam 13. The support member 76 may be provided with a mounting flange 77 (FIG. 3) at the bottom thereof to facilitate mounting of the support member on the cross beam 13. A pulley 78 is secured to one end of the shaft 73, and a belt 82 drivingly connects the pulley 78 with another pulley 83 secured to the output shaft 84 of a reduction gear unit 86 is connected to the output shaft (not shown) of a reversible electric motor 87 mounted on the cross beam 13. The period of energization and direction of current flow to the electric motor 87 is controlled by electrical circuitry, a portion of which is contained in a housing 88 mounted on the cross beam 13. Such electrical circuitry includes at least one and preferably a pair of laterally spaced photo-electric scanning heads 92 and 93, which coact with the side edges of a portion W′ of the web W in a well known manner to provide signals for controlling the operation of the electric motor 87.

As best seen in FIGS. 5 and 6, the drum 72 includes a cylindrical portion 94 around which one or more turns of the cable, indicated at 95, of the cable and capstan drive 70 are wound. In order to prevent the cable 95 from slipping on the drum 72, a secantally-shaped, diagonally extending slot 103 is milled or otherwise formed in the cylindrical portion 94 to permit a portion 104 of the cable to extend into the slot 103. A radially extending bore 106 in the drum 72 bisects the slot 103, and the portion 104 of the cable 95 in the slot 103. A sufficient number of turns of the cable 95 are wrapped around the portion 94 of the drum 72 to accommodate the maximum tilt positions of the frame 30.

In order to facilitate connection of the end portions, indicated at 97 and 98, of the cable 95 to the ends of the tie rod 50 and also to adjust the tension in the cable 95, a pair of connectors 109 and 110 are respectively secured to the end portions 97 and 98.

The connectors 109 and 110 thus respectively include elongated, tubular housing portions 111 and 112, the axially outer ends of which are internally threaded as at 113 to receive the threaded shanks 114 of cable tensioning screws 115 having enlarged heads 116. The outer ends of the cable tensionsing screws 115 of each connector extend through openings in plate-like, oval-shaped brackets 117 secured to the respective ends of the tie rod 50. Thus, rotation of the heads 116 of the tensioning screws 115 in opposite directions, effects adjustment of the tension in the cable 95. Lock nuts 118 may be threaded onto the shanks 114 of the screws 115 for maintaining the screws in an adjusted position. The end portion 97 of the cable 95 is fixedly secured in an axial bore 122 in the connector 109 by a set screw 123 threaded into a transverse bore 125 in the housing 111 and intersecting the bore 122.

The connector 110 is similar to the connector 119 in that the former also includes a set screw 121 for securing the end portion 98 of the cable 95 in the connector but differs therefrom in that the connector 110 includes compressible spring means, observable from the exterior thereof, for indicating the degree of tension in the cable 95 and for maintaining tension therein during movements of the tilt frame 30. To this end, a tubular guide member 126 is threaded into the axially inner end of the housing 112 and an axially shiftable anchor member 127 is mounted in the housing 112 and provided with an axial bore therethrough for receiving the remote outer end of the cable end portion 98. The set screw 121 is threaded into a transverse bore 128 in the anchor member 127 for locking the remote end of the cable end portion 98 in the anchor member 127.

The aforementioned spring means of the connector 110 preferably comprises a plurality of Belleville spring washers 130 disposed between the adjacent end faces of the guide member 126 and anchor member 127 and arranged in alternating concave and convex relation. Since the axial length of the stack of Belleville washers will vary in accordance with compression load thereon and since the tension force in the cable 95 is transmitted to the washers 130 through the shiftable anchor member 127 and resisted by the washers, the change in length of the stack of washers provides a direct indication of the tension in the cable 95.

In order to permit observation of the change in length of the stack of washer 130, the housing 112 is provided with an axially extending opening or window 132 (FIGS. 5 and 7) having a length at least equal to the maximum travel of the anchor member 127 and the length of the stack of Belleville washers 30 when the latter are uncompressed. The window 132 thus permits observation of the edges of the Belleville washers 130 from the exterior of the housing 112.

In order to facilitate measurement of the change in length of the stock of washers 130 as the tension in the cable 95 is being adjusted by manipulation of the tensioning screws 115, a circumferentially extending index mark 133 may be scribed or otherwise formed on the exterior of the housing 112 at a convenient location next to the window 132. It will be understood that some other type of spring means, such as a coil spring, could be used in place of the Belleville washers 130. It will further be understood that the connector 110 could be used in applications other than the web aligning apparatus 10.

With the foregoing construction, it will be apparent that rotation of the capstan or drum 72 in either direction by the electric motor 87 will cause corresponding axial shifting movements of the tie rod 50, which movements are transmitted to the links 38 and 39 and thence to the tilt frame 30. However, since the tilt frame is a substantially rigid structure and since the links 38 and 39 are inclined forwardly and inwardly toward the entrance roller 32, the bifurcated ends 47 of the links 38 and 39 move at different angular rates and by different amounts as the tilt frame 30 shifts in either direction. Accordingly, the tie rod 50 includes resilient means for compensating for the small changes in spacing between the bifurcated ends 47 of the links 38 and 39 during shifting movements of the tilt frame 30.

As best seen in FIG. 5, the aforementioned resilient means in the tie rod 50 comprises an elastic material insert 135 mounted in a bore 136 in the enlarged portion 137 of a pair of rod end bearings 141 and 142, which are threaded into the respective ends of the tie rod 50. The resilient material insert 135 surrounds a tubular bearing insert 143 of bronze or similar bearing material. The cross pins 48 of the links 38 and 39 extend through and are rotatably journalled in the bearing inserts 143 of the rod end bearings 141 and 142. The resilient insert 135 may be of any material having the desired strength and elasticity requirements but is preferably of urethane having a Durometer of 50°–75° Shore "A". Thus, the resilient inserts 135 accommodate the small changes in spacing between the bifurcated ends 47 of the links 38 and 39 during tilting movements of the frame 30 when the apparatus is functioning to correct a misalignment of the web W.

As heretofore mentioned, the web aligning apparatus 10 includes at least one and preferably a pair of photoelectric scanning heads 92 and 93 for sensing lateral deviations of the portion W′ of the web W from a desired path of travel through the apparatus 10 and hence through a device with which the apparatus 10 is associated. To this end, the scanning heads 92 and 93, which are of a conventional construction, are mounted on an elongated support bar 145 for coaction with the side edges of the web portion W′ in a well known manner. The support bar 145 extends transversely of the path of travel of the web portion W′ and has its ends connected to mounting structure 150 now to be described and carried by the support plates 11 and 12.

As best seen in FIG. 2, each mounting structure 150 comprises a guide member in the form of a rod 152 supported at its ends in brackets 153 and 154 secured to the inner surface of its respective support plate 11 and 12 so that the rod 152 lies in a plane extending generally parallel to the plane of movement of the tilt frame 30 and perpendicular to the web portion W'. The rods 152, in the present instance, are circular in cross section and are bent or otherwise formed with a curvature, the center of which is disposed in the plane of the portion W' of the web and midway between the ends of the exit roller 33 of the tilt frame 30. Such arcuate center of the guide rods 152 is indicated generally at 155 in FIG. 2.

Each guide structure 150 also includes a carriage comprising a pair of bearing blocks 162 and 163, which are slidably mounted on each guide rod 152 and which are maintained in spaced relation by a resilient member in the form of a flat spring 164. The ends of the spring 164 are bolted or otherwise secured to the bearing blocks 162 and 163, and the respective ends of the scanner support bar 145 are likewise bolted or otherwise secured centrally to the flat spring 164. Thus, any inaccuracies or misalignment of the parts of the tilt frame 30 and guide structures 150 are compensated for by the resiliency of the flat springs 164 during tilting movements of the tilt frame 30.

In order to effect movement of the scanner head support bar 145 so that the scanning heads 92 and 93 follow their respective side edges of the web portion W' during tilting movements of the tilt frame 30, a linkage arrangement is provided for interconnecting the bearing blocks 162 of the scanner head support bar carriages with their respective side frame members 36 and 37. Such linkage includes a pair of posts 166 threaded into or otherwise rigidly secured to the undersides of the side frame member 36 and 37 at points somewhat forwardly of the longitudinal centers of the frame members. The posts 166 extend vertically downwardly from the undersides of the frame members 36 and 37, as viewed in FIG. 2, and provide a mounting for the ends 167 of a pair of tie rods 168. The opposite ends, indicated at 169, of the tie rods 168 are connected to the bearing blocks 162. Suitable rod end bearings are provided at the respective ends of the tie rods 168 to permit free pivotal movement of said ends at their points of connection with the posts 166 and bearing blocks 162.

In order to facilitate connection of the tie rod ends 169 to the bearing blocks 162, these bearing blocks are provided with enlarged portions 172 (FIG. 8) for receiving screws 173 extending through ball joints 174 in the ends 169 of the tie rods 167.

Operation of the Web Aligning Apparatus 10

Assuming that the web aligning apparatus 10 has been installed in a desired location along the path of travel of a web of material, such as newsprint or the like, where it is necessary to accurately maintain the web on such path, the web is initially threaded through the apparatus 10 in the manner illustrated in FIG. 3. Thus, the incoming web passes under the idler roller 21 and thence upwardly and over the entrance roller 32 of the tilt frame 30. The web is then carried over the exit roller 33 of the tilt frame and then passes downwardly and under the idler roller 22 from which it exits from the apparatus 10. Assuming further that the photoelectric scanning heads 92 and 93 have been positioned on the support bar 145 in accordance with the width and path of travel to be maintained by the web, the apparatus 10 is then ready to perform its web aligning function if the web starts to deviate from the prescribed path of travel.

Thus, if the web should start to shift laterally toward the left as viewed in FIG. 2, for example, such lateral shift is sensed by the scanner heads 92 and 93 and an electrical signal is generated in the electrical circuitry to energize the electric motor 87 for rotation in an appropriate direction to correct the misalignment of the web. Since it has been assumed that the web W is drifting toward the left, as viewed in FIG. 2, the motor 87 will be driven in a direction to cause rotation of the output pulley 83 of the reduction gear unit 86 and consequently rotation of the pulley 78, drive shaft 73 and drum 72 of the cable and capstan drive 70 in a direction to shift the tie rod 50 to shift toward the right as viewed in FIG. 2. Such movement is accomplished by the cable 95, which is centrally secured to the drum 72 and connected to the respective ends of the tie rod 50 through the cable end connections 109 and 110, and brackets 117 (FIG. 5).

Shifting of the tie rod 50 toward the right causes the links 38 and 39, which are pivotally connected to the bearing blocks 44 secured to the inner surfaces of the side plates 11 and 12, to pivot in a clockwise direction about the axes of the pins 43. Clockwise movement of the links 38 and 39 effects a corresponding movement of the side frame members 36 and 37 of the tilt frame 30 since the frame members 36 and 37 are pivotally connected to the links 38 and 39 by the pivot pins 46.

The geometry of the connections of the links 38 and 39 with the tilt frame 30 is such that the instantaneous center of rotation of the tilt frame 30 throughout the normal range of tilting movements thereof is at all times located upstream from the entrance roller 32 thereof and thus outside the perimeter of the tilt frame. Moreover, because of the forward and inward inclination of the links 38 and 39, the locus of movement of the instantaneous center of rotation of the tilt frame 30 is along an arcuate path indicated generally at P in FIG. 9. Such path is concave with respect to the steering rollers 32 and 33.

Since the path of travel P of the instantaneous center of rotation of the tilt frame 30 is arcuate and is located outside the perimeter of the tilt frame and upstream from the portion, indicated at W'', of the web traversing the steering rollers 32 and 33, sheer stresses and strain lines in the web are minimized. In addition, the aforementioned location of the path of movement of the instantaneous center of the tilt frame 30 prevents the tilt frame from exerting a steering effect on the web either upstream or downstream from the tilt frame 30.

The forward ends 35 of the side frame members 36 and 37 of the tilt frame 30 are supported in sliding bearing assemblies 51 and 52, which accommodate simultaneous longitudinal and lateral movement of the forward ends of the tilt frame members as the tilt frame tilts to correct the path of travel of the web. The aforementioned sliding movement of the forward ends of the tilt frame member is accommodated by the sandwiched relation of the ends 35 between the spaced flanges 58 of the channel-shaped bearing member 62 of each of the bearing assemblies 51 and 52. Moreover, the utilization of the tool steel plates 57 on the inner surfaces of the flange portions 58 of the bearing members 62, and the bronze, bearing disks 59 on the adjacent side faces of the side frame members 37 and 38 assure a long useful life of the bearing assemblies 51 and 52.

Since the tilt frame 30 is a rigid structure and since the ends of the tie rod 50 are connected to the ends of the links 38 and 39, which are also connected intermediate their length by the pins 46 to the side frame members 36 and 37 of the tilt frame, the small change in the spacing between ends 47 of the links 38 and 39 during tilting movements of the tilt frame 30 is accommodated by the urethane inserts 135 in the rod end bearings 141 and 142.

Proper tension in the cable 95 of the cable and capstan drive 70 is indicated and maintained by the end connector 110. Thus, the compressibility of the Belleville washers 130 between the cable guide member 126 and cable anchor member 127 permits an operator to adjust the tension in the cable 95 by rotating either one or both of the screws 115 and noting the position of the reference mark 133 (FIG. 7) on the exterior of the housing 112 with respect to the edges of the Belleville washers 130 or the adjacent end face of the anchor member 127. The washers 130 also maintain tension in the cable 95 during movements of the tilt frame.

Movement of the scanner heads 92 and 93 with respect to the portion W′ of the web between the exit roller 33 and idler roller 22 is assured by the guide structures 150 which support the ends of the scanner head support bar 145 for movement about the pivot point 155. The aforementioned alignment function of the guide structures 150 is achieved in part as a result of the center of the radius of curvature of the arcuate guide rods 152 thereof being located in the plane W′ of the web and midway between the side plates 11 and 12. Minor inaccuracies in the parts of the guide structures 150 is accommodated by the flat springs 164 to which the ends of the scanner bar 145 are secured.

I claim:

1. In an apparatus for returning a moving web to a desired path of travel after a lateral deviation therefrom, said apparatus comprising support structure including a pair of laterally spaced support members, a tilt frame disposed between said support members, said tilt frame including a pair of laterally spaced, longitudinally extending frame members, at least one steering roller rotatably mounted at its ends in said frame members, said roller being arranged so that its axis extends generally transversely to the path of travel of said web, and means connecting said tilt frame to said support members for tilting movement with respect to said web, the improvement of sliding bearing means carried by at least one of said support members and at least one of said frame members for supporting said tilt frame and guiding the movements thereof, said sliding bearing means having bearing surfaces permitting said one frame member to slide relative to said one support member in only one plane and said tilt frame to tilt only in said one plane.

2. The apparatus of claim 1, in which said sliding bearing means comprises at least one flat bearing surface on said one support member and at least one flat bearing surface on said one tilt frame member, said last mentioned bearing surface slidingly engaging said first-mentioned bearing surface.

3. The apparatus of claim 2, in which a pair of said flat bearing surfaces are provided on said one support member, said support member bearing surfaces being parallel and arranged laterally opposite to each other.

4. The apparatus of claim 3, in which a pair of bearing members are secured to said one tilt frame member, said bearing members providing a pair of said second-mentioned bearing surfaces for slidably engaging said support member bearing surfaces and limiting tilting movements of said tilt frame to said one plane.

5. In an apparatus for returning a moving web to a desired path of travel after a lateral deviation therefrom, said apparatus comprising support structure including a pair of laterally spaced support members, a tilt frame disposed between said support members, said tilt frame including a pair of laterally spaced, longitudinally extending tilt frame members having forward and rearward ends, at least one steering roller rotatably mounted at its ends in said frame members, said roller being arranged so that its axis extends generally transversely to the path of travel of said web, and a pair of elongated link members pivotally connecting said tilt frame members to said support members, the pivotal connections of said link members to said tilt frame members being respectively located adjacent to the rearward ends of said tilt frame members, the improvement of a pair of sliding bearing assemblies carried by said support members and said tilt frame members for supporting said tilt frame and guiding the movements thereof, said sliding bearing assemblies being respectively located at the forward ends of said tilt frame members and permitting said tilt frame members to slide relative to said support members during tilting movement of said tilt frame.

6. The apparatus of claim 5, in which a pair of said steering rollers are rotatably carried by said tilt frame, said rollers being arranged so that their axes are parallel and extend generally transversely to the path of travel of said web, one of said steering rollers being rotatably carried by said tilt frame members somewhat rearwardly of the forward ends thereof and the other of said steering rollers being rotatably carried by said tilt frame members rearwardly of the pivotal connection of said link members thereto.

7. The apparatus of claim 5, in which the pivotal connections of said link members to said tilt frame members are positioned forwardly of the connection of said link members to their respective support members, whereby the longitudinal axes of said link members are inclined inwardly toward the forward ends of said tilt frame members throughout the normal range of movement of said tilt frame.

8. The apparatus of claim 7, in which said link members have portions which extend inwardly beyond the pivotal connections thereof to said frame members, and a tie rod extends between and is pivotally connected to the respective ends of the inwardly extending portions of said link members, whereby movements of said tie rod in opposite directions effects tilting movements of said tilt frame in opposite directions.

9. The apparatus of claim 8, in which said tie rod includes resilient means for accommodating changes in the spacing between said ends of said link members during tilting movements of said tilt frame.

10. The apparatus of claim 9, in which at least one end of said tie rod is provided with a tubular bushing for receiving a pivot pin, and said resilient means comprises an annular elastic material insert surrounding said bushing.

11. The apparatus of claim 10, in which said insert is of urethene.

12. In an apparatus for maintaining a web of material on a desired path of travel, including support structure, frame means having at least one web steering roller rotatably carried thereby, and means connecting said frame means to said support structure for tilting movements in opposite directions to correct the path of travel of said web, the improvement of cable and capstan drive means carried by support structure and connected to said frame means, said cable and capstan drive means being operable to effect tilting movements of said frame means in opposite directions to correct the path of travel of said web.

13. The apparatus of claim 12, in which the capstan of said cable and capstan drive means comprises a drum rotatably mounted on said support structure, and said cable being centrally connected to said drum and having its ends connected to said frame means.

14. The apparatus of claim 13, in which the outer surface of said drum is generally cylindrical, a secantally-shaped slot is provided in said drum for receiving a portion of said cable, and clamping means is provided for releasably retaining said portion of said cable in said slot.

15. The apparatus of claim 14, in which said slot is inclined with respect to the axis of rotation of said drum, and the ends of said slot terminate adjacent to the axial ends of said drum, whereby at least one turn of said cable may be wound around said drum and positioned between the portions thereof extending circumferentially from the ends of said slot.

16. The apparatus of claim 14, in which said clamping means comprises a set screw threaded into said drum and engaging the portion of said cable disposed in said slot.

17. The apparatus of claim 16, in which said set screw is threaded into a radial bore which bisects said slot.

18. In a web aligning apparatus comprising support structure including a pair of laterally spaced support members, frame means disposed between said support members and having at least one web steering roller rotatably mounted thereon, means connecting said frame means to said support structure for tilting movement in opposite directions to correct lateral deviations of said web from a desired path of travel, an elongated support member extending generally transversely of the path of travel of said web through said apparatus, and means carried by said elongated support member and coacting with at least one of the side edges of said web for affecting said tilting movement of said frame means, the improvement of mounting structure for supporting the respective ends of said elongated support member for tilting movement with said frame means, said mounting structure including an elongated guide member mounted on each of said support members, and a carriage slidably mounted on each of said guide members, each of said carriages including a resilient member to which one of the respective ends of said elongated support member is connected, said resilient members accommodating changes in the transverse distance between said guide members during tilting movement of said elongated support member.

19. The apparatus of claim 18, in which each of said guide members comprises a rod secured to the inner surface of one of said support members so as to lie in a plane substantially parallel to the plane of movement of said tilt frame.

20. The apparatus of claim 19, in which each of said carriages comprises at least one tubular member slidably mounted on said rod, said resilient member is elongated and connected at one end to said tubular member, and said elongated support member is connected to said resilient member at a point spaced from said one end thereof.

21. The apparatus of claim 20, in which each of said carriages comprises a pair of tubular members slidably mounted on said rod, said resilient member is connected at its respective ends to said tubular members, and said elongated support member is connected to said resilient member substantially at the midpoint thereof.

22. The apparatus of claim 20, in which said resilient member comprises a flat spring.

23. The apparatus of claim 19, in which said frame means comprises a tilt frame having a pair of laterally spaced, generally longitudinally extending frame members, a pair of steering rollers are rotatably carried by said tilt frame members so that their axes are parallel and extend generally transversely to the path of travel of said web, the upstream roller of said pair comprising an entrance roller and the downstream roller of said pair comprising an exit roller, said guide member rods are curved, and the centers of the radii of curvature of said rods are located at a point disposed substantially at the midpoint of said web when the latter is moving on said desired path of travel, said point also lying in a plane which extends substantially perpendicular to the plane of said web between said steering rollers and which is tangent to said exit roller.

24. The apparatus of claim 23, in which a tie rod is connected at one end to said carriage means and at its other end to an adjacent frame member of said tilt frame.

25. In an apparatus for returning a moving web to a desired path of travel after a lateral deviation therefrom, said apparatus comprising support structure including a pair of laterally spaced support members, a tilt frame disposed between said support members, said tilt frame including a pair of laterally spaced, longitudinally extending frame members, at least one steering roller rotatably mounted at its ends in said frame members, said roller being arranged so that its axis extends generally transversely to the path of travel of said web, and means connecting said tilt frame to said support members for tilting movement with respect to said web, the improvement of sliding bearing means carried by at least one of said support members and at least one of said frame members for supporting said tilt frame and guiding the movements thereof, said sliding bearing means comprising a channel-shaped member secured to said one support member and having spaced flanges, the adjacent inner surfaces of said flanges defining a pair of flat, parallel, laterally oppositely arranged bearing surfaces on said one support member, and said one tilt frame member having a pair of flat bearing surfaces slidingly engaging the bearing surfaces on said one said support member to permit tilting movement of said tilt frame.

26. The apparatus of claim 25, in which a pair of hardened plates are secured to the inner surfaces of said flanges, the opposed surfaces of said plates providing said first-mentioned bearing surfaces.

* * * * *